United States Patent [19]

Besore et al.

[11] Patent Number: 4,736,997

[45] Date of Patent: Apr. 12, 1988

[54] HOUSEHOLD REFRIGERATOR SHELF ASSEMBLY

[75] Inventors: John K. Besore; Bruce L. Ruark, both of Louisville, Ky.

[73] Assignee: General Electric Company, Louisville, Ky.

[21] Appl. No.: 58,790

[22] Filed: Jun. 5, 1987

[51] Int. Cl.[4] ..... A47B 96/06

[52] U.S. Cl. ..... 312/236; 312/214; 312/296; 108/108

[58] Field of Search ..... 312/236, 296, 214; 108/108, 152; 211/153

[56] References Cited

U.S. PATENT DOCUMENTS

| | | | |
|---|---|---|---|
| 2,002,328 | 5/1935 | Mitchell | 108/152 |
| 3,538,860 | 11/1970 | Fisher | 108/152 |
| 3,556,306 | 1/1971 | Shell | 108/108 |
| 3,614,044 | 10/1971 | Bard | 108/108 |
| 3,680,941 | 8/1972 | Shanks | 312/296 |
| 3,707,317 | 12/1972 | Dawley et al. | 312/214 |
| 4,365,562 | 12/1982 | Webb | 108/108 |
| 4,373,694 | 2/1983 | Peterson | 108/108 |
| 4,691,887 | 9/1987 | Bessinger | 108/108 |

*Primary Examiner*—Victor N. Sakran
*Attorney, Agent, or Firm*—Frederick P. Weidner; Radford M. Reams

[57] ABSTRACT

A household refrigerator shelf assembly comprising a removable rigid unitary frame having two spaced apart shelf brackets, a front horizontal support member and a rear horizontal support member, both being rigidly attached to and spanning the distance between the brackets. The rear horizontal support member as viewed in lateral cross-section has a vertical wall at the top and a depending rearwardly directed horizontal flange terminating in a downwardly directed terminal end portion spaced rearwardly from the vertical wall, the bottom of the vertical wall having a forwardly directed horizontal flange with a downwardly directed rib. There is a reflector member attached to the rear horizontal support member and spanning the distance between the brackets. The reflector member as viewed in lateral cross-section has an upper vertical portion with a right angle bend at the bottom and a bottom portion. The bottom portion has a rearwardly directed horizontal section supported by the top of the rearwardly directed horizontal flange of the rear support member and has a downwardly directed vertical section with a right angle bend at the bottom and a substantially horizontal flange section extending forwardly from the right angle bend. The flange section has an upwardly directed projection capturing the terminal end of the downwardly directed terminal end of the rear support member between it and the right angle bend and a curved section forward of the projection that frictionally engages the rib of the rear support member. The shelf assembly has a cover supported on the frame.

8 Claims, 3 Drawing Sheets

HOUSEHOLD REFRIGERATOR SHELF ASSEMBLY

BACKGROUND OF THE INVENTION

This invention relates to household refrigerators including combination refrigerators; that is, a refrigerator including a freezer compartment and a fresh food compartment.

The fresh food storage compartment of a refrigerator often includes a number of vertically spaced cantilevered shelves which are movably supported on elongated vertical ladder tracks fastened to the liner of the compartment. It is desirable in this type of shelf that there be a shelf reflector attached to the rear of the shelves that functions to help hold the shelf components together and to enhance appearance. With full width cantilevered shelves the reflector must be secured to the shelf in such a manner that the reflector is not bowed rearwardly in the event food items or beverages are pushed against it during the course of using the refrigerator.

By this invention there is provided a shelf assembly for a household refrigerator which includes a reflector that helps hold the shelf assembly together, enhances the appearance of the shelf and is designed to prevent bowing of the reflector rearwardly in the event food items and beverages are pushed against it.

SUMMARY OF THE INVENTION

There is provided a shelf assembly for a refrigerator with a fresh food compartment comprising a removable rigid unitary frame having two spaced apart shelf brackets, a front horizontal support member and a rear horizontal support member, both being rigidly attached to and spanning the distance between the brackets. The rear horizontal support member as viewed in lateral cross-section has a vertical wall and at the top thereof a depending rearwardly directed horizontal flange terminating in a downwardly directed terminal end portion spaced rearwardly from the vertical wall, the bottom of the vertical wall having a forwardly directed horizontal flange with a downwardly directed rib. A reflector member is attached to the rear horizontal support member and spans the distance between the brackets, said reflector member as viewed in lateral cross-section having an upper vertical portion with a terminal end at the top and a right angle bend at the bottom and a bottom portion. The bottom portion has a rearwardly directed horizontal section supported by the top of the rearwardly directed horizontal flange of the rear support member and has a downwardly directed vertical section with a right angle bend at the bottom and a substantially horizontal flange section extending forwardly from the right angle bend. The flange section has an upwardly directed projection capturing the downwardly directed terminal end of the rear support member between it and the right angle bend and a curved section forward of the projection that frictionally engages the rib of the rear support member. There is a cover supported on the frame.

DESCRIPTION OF THE PREFERRED EMBODIMENT

Figure 1:
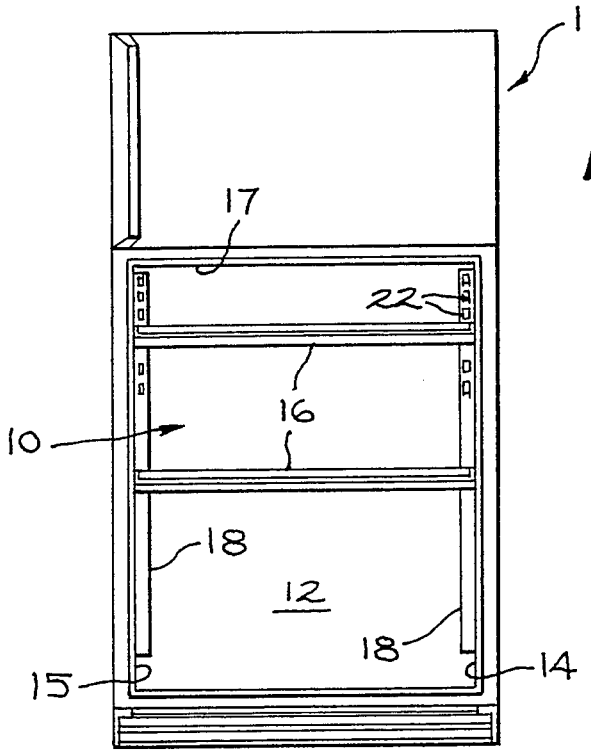
FIG. 1 is a front elevational view of a household refrigerator showing one embodiment of the shelf assembly of the present invention.

With particular reference to FIG. 1 of the drawings, there is shown a household refrigerator cabinet 1, including a fresh food storage compartment 10, defined by a rear wall 12 and spaced from side walls 14 and 15; the compartment having an access opening 17 at the front thereof closed by a door (not shown).

Compartment 10 contains a plurality of vertically spaced full width storage shelves 16 which occupy substantially the entire horizontal cross-sectional area of the compartment 10.

It is desirable that the shelves of a refrigerator be vertically adjustable in order to provide spacing of the shelves as desired by the user. In order to provide means by which the user may quickly select the desired vertical position of the shelves, there is, as shown in FIG. 1, vertically elongated tracks 18 to which the shelves are movably secured. In the preferred embodiment of the present invention, there are only two spaced parallel elongated rigid tracks 18 secured to the rear wall 12 in close proximity to the inside corner formed by the vertical rear wall 12 and either the vertical side wall 14 or 15 which intersect each other at a right angle. The tracks 18 are made of rigid material to withstand the weight of the shelves and the food items and beverages stored thereon and they are attached to the liner of compartment 10 by any suitable means which usually are headed attachment elements such as screws (not shown). The tracks 18 have a plurality of rectangular slots 22 along the length of each. These slots 22 are for securing the shelves and to accommodate vertical movement of the shelves which will be discussed later. These kind of tracks are often referred to as ladder tracks.

Figure 2:
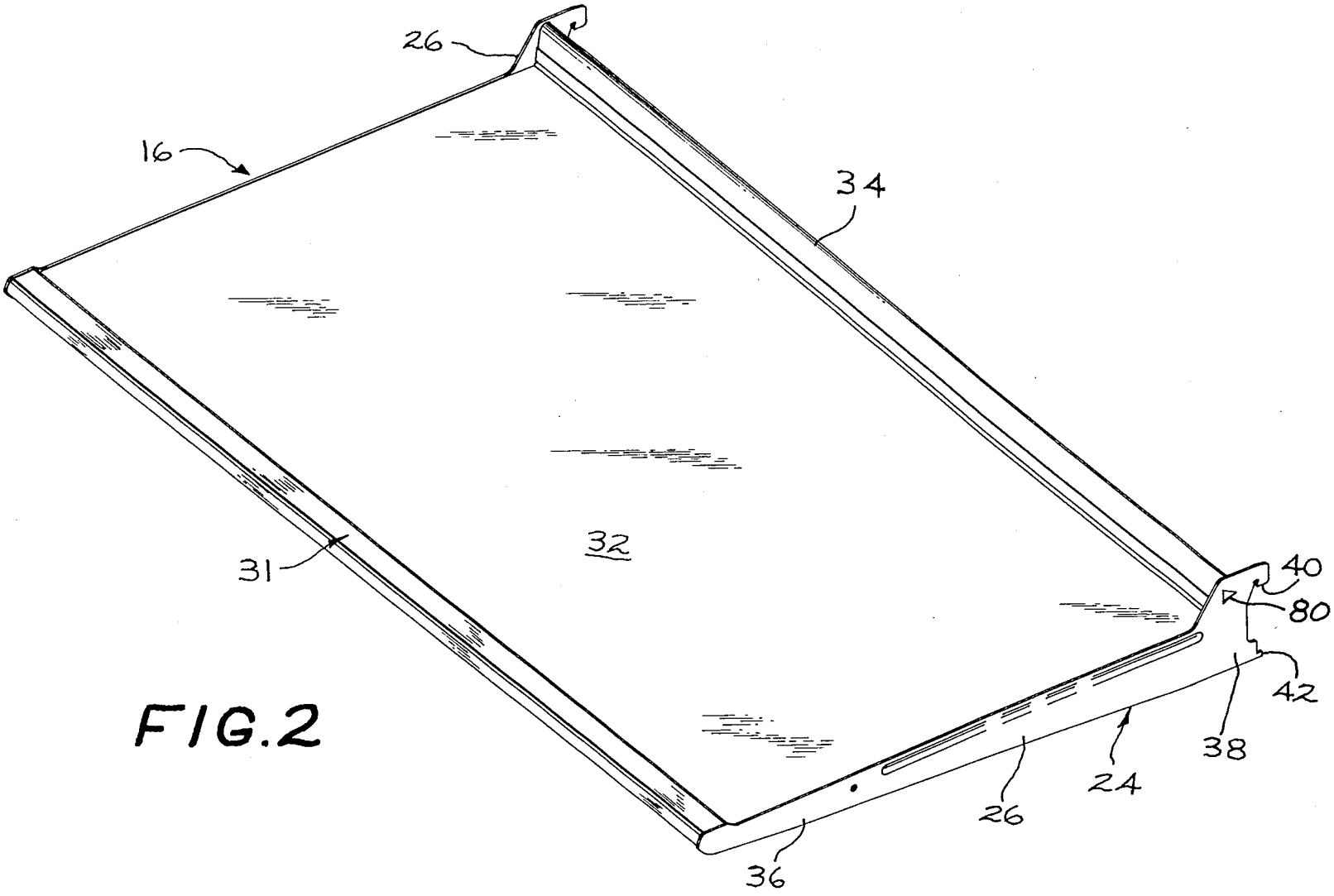
FIG. 2 is a perspective view of the shelf assembly of the present invention.

With particular reference to FIG. 2, there is shown the shelf assembly of the present invention and includes a removable rigid unitary frame 24 having two spaced apart shelf brackets 26, a front horizontal support member 28 (FIG. 3) and a rear horizontal support member 30 (FIG. 4), both of which in the preferred embodiment are of the same shape and configuration and roll formed from steel. Both support members are rigidly attached to brackets as by welding and span the distance between the brackets 26. The shelf assembly includes a cover 32 which is supported on the frame 24 and in the case of the preferred embodiment the cover is tempered glass. At the rear of the shelf assembly there is a reflector 34 which snaps over the rear horizontal support member 30 and functions to hold the components at the rear of the shelf assembly together and adds a decorative appearance to the shelf assembly.

Figure 3:
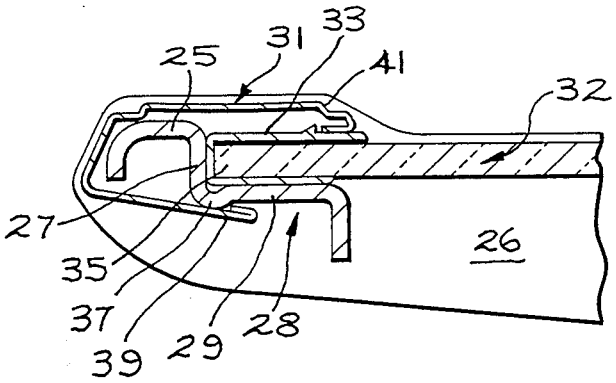
FIG. 3 is a side elevational view of the front portion of the shelf assembly shown in cross-section.

With reference to FIG. 3, the front end of the shelf assembly arrangement is shown in cross-section. The front horizontal support member 28 has a horizontal flat section 29, a vertical section 27 and a downwardly curved section 25. A front trim member 31 which is U-shaped snaps over the support member 28. Captured between the front horizontal support member 28 and the front trim member 31 is a U-shaped gasket 33 which grips the front edge 35 of the cover 32 to resiliently secure the front of the cover 32 on the frame 24. The bottom leg 39 of the trim member 31 engages a rib 37 formed at the junction of the horizontal flat section 29 and the vertical section 27 of the front horizontal support member 28 and the upper leg 41 engages the gasket 33. With this arrangement the trim member 31 holds the structural components of the front of the shelf assembly together and also provides a decorative appearance.

For securement of the shelf assembly 16 to the tracks 18 the brackets 26 have a forward portion 36 and a rearward portion 38 having means for removable securement to the tracks 18. In the case of the preferred embodiment of the present invention, the removable securement means includes an upper hook-shaped element 40 which is removably inserted in one of the slots 22 of the tracks 18. For this purpose, the hook-shaped element 40 is dimensioned to be slightly smaller than the slots 22 so that it may be received therethrough. Also, on the track securing portion 38 of the brackets 26 and located below the hook-shaped element 40 is a tab 42 dimensioned to be slightly smaller than the slots 22 and, therefore, received in one of the slots 22. The tab 42 is utilized to stabilize the brackets 26 when they are engaged in the tracks 18. With this tab 42, lateral movement of the track securing portion 40 of the brackets 26 is limited and also unintentional upper movement of the track securing portion 40 is prevented. By this arrangement then, to remove the brackets 26 from the tracks 18, the brackets must be rotated upwardly to pivot about hook-shaped portion 40 and, thus, disengage the tab 42 from the slot 22 in which it is inserted and then remove the hook-shaped element 40 from engagement with the slot 22 in which it is inserted. It will be understood that the brackets 26 may be easily moved up and down along the tracks 18 and secured to them at whatever elevated position of the shelf assembly is desired by the user.

Figure 4:
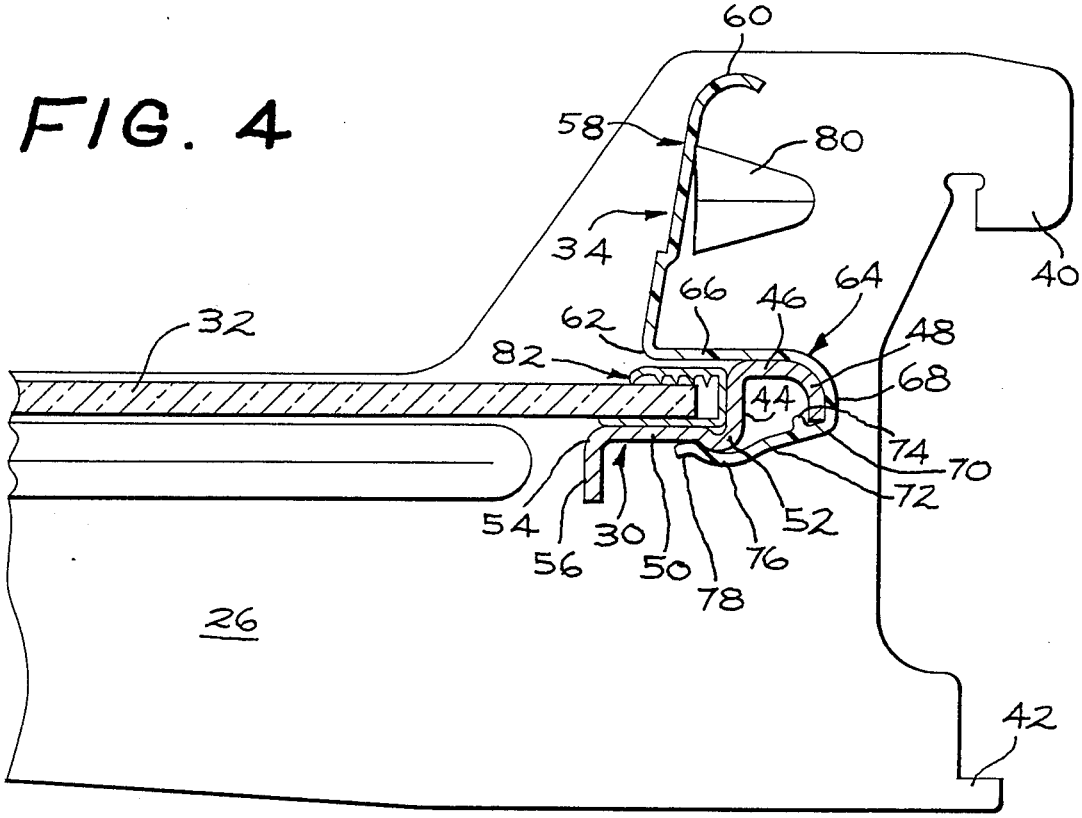
FIG. 4 is a side elevational view of the rear portion of the shelf assembly shown in cross-section.
Figure 5:
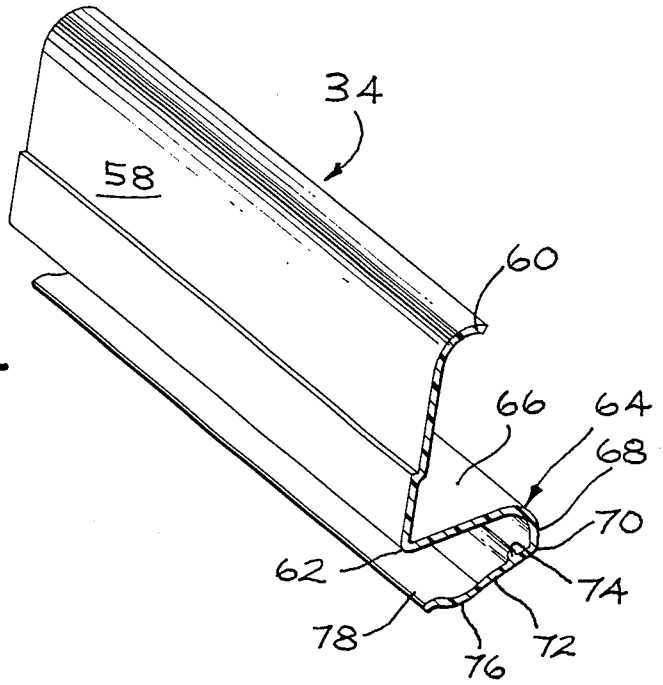
FIG. 5 is a perspective partial view of the reflector utilized in the shelf assembly of the present invention.

With reference to FIGS. 4 and 5 in particular, the structural arrangement for the rear of the shelf assembly 16 will be described. The rear horizontal support member 30 is an elongated roll formed steel member secured at each end thereof to space apart brackets 26 by any suitable manner such as welding. The rear horizontal support member 30 as viewed in lateral cross-section, which is shown in FIG. 4, has a vertical wall 44 and at the top thereof a depending rearwardly directed horizontal flange 46 terminating in a downwardly directed terminal end portion 48 which is spaced rearwardly from the vertical wall 44. The bottom of the vertical wall 44 has a forwardly directed horizontal flange 50 with a downwardly directed rib 52 which in the preferred embodiment is located at the junction of the vertical wall 44 and the forwardly directed horizontal flange 50. To add strength to the rear horizontal support member, the forwardly directed horizontal flange 50 has a right angle bend 54 and a vertical terminal end 56.

The reflector member 34 is shown in cross-section in FIG. 4 and in perspective in FIG. 5 and in the case of the preferred embodiment the reflector member is molded from suitable plastic material. The reflector member is attached to the rear horizontal support member 30 and spans the distance between the brackets 26. The reflector member as viewed in lateral cross-section as shown in FIG. 4 has an upper vertical portion 58 with a terminal end 60 at the top and a right angle bend 62 at the bottom and a bottom portion generally indicated as 64. The bottom portion 64 has a rearwardly directed horizontal section 66 supported by the top of the rearwardly directed horizontal flange 46 of the rear support member 30 and has a downwardly directed vertical section 68 which, as can be seen in FIG. 4, is complementary to the downwardly directed terminal end portion 48 of the rear horizontal support member 30. The bottom portion 64 of the reflector member 34 has a generally right angle bend 70 at the bottom of the downwardly directed vertical section 68 and a substantially horizontal flange section 72 extending forwardly from the right angle bend 70. The flange section 72 has an upwardly directed projection 74 which captures the downwardly directed terminal end 48 of the rear support member 30 between it and the right angle bend 70. The horizontal flange section 72 also has a downwardly curved section 76 forward of the projection 74 that frictionally engages the rib 52 of the rear support member 30. The horizontal flange section 72 has terminal end 78 forwardly of the curved section 76.

With reference to FIG. 4, it can be readily seen that the bottom portion 64 of the reflector member 34 is inserted around the rearwardly directed horizontal flange 46 of the support member 30 and the downwardly directed terminal end portion 48 of the rear horizontal support member 30 and is prevented from rearward movement by capturing the terminal end 48 between the right angle bend 70 and the upwardly directed projection 74. Additional rigidity is accomplished by the curved section 76 of the reflector member engaging the rib 52 of the rear horizontal support member 30. With the horizontal flange section 72 of the reflector member being relatively long and extending from the right angle bend 70 to the terminal end 78, any force against the upper vertical portion 58 in the rearward direction causes the horizontal flange section 72 to act as a lever arm and rotate in an upwardly direction, thereby increasing the gripping engagement of the horizontal flange section 72 against the rear horizontal support member 30.

To prevent twisting of the reflector member 34 at the ends next to the brackets 26 there is provided a stop member 80 which may be in the form of a V-shaped indentation in each of the shelf brackets. The stop members 80 project toward each other which, as can be seen in FIG. 4, will prevent the ends of the reflector member from being moved rearwardly from the position as shown in FIG. 3 and thus prevent twisting of the elongated reflector member 34.

To complete the shelf assembly there is a gasket 82 having a U-shaped body as viewed in lateral cross-section as shown in FIG. 4 with the body being opened at the forward end to receive therein the cover 32. With this arrangement, movement of the cover 32 upwardly in a vertical direction is prevented as the rear edge of the cover is retained within the gasket 82 and the gasket is retained between the forwardly directed horizontal flange 50 of the rear horizontal support member 30 and the rearwardly directed horizontal section 66 of the reflector member 34. Thus, with this arrangement the reflector member functions to hold the rear structural members of the shelf assembly together and when made of a decorative plastic material it also enhances the appearance of the shelf assembly. In connection with the aspect of appearance, upper vertical portion 58 of the reflector member 34 may be readily modified to change the color or finish to meet sales appeal demands in the market place.

The foregoing is a description of the preferred embodiment of the invention and it should be understood that variations may be made thereto without departing from the true spirit of the invention as defined in the appended claims.

What is claimed is:

1. In a refrigerator with a fresh food compartment, a shelf assembly comprising:

a removable rigid unitary frame having two spaced apart shelf brackets, a front horizontal support member and a rear horizontal support member, both being rigidly attached to and spanning the distance between the brackets, said rear horizontal support member as viewed in lateral cross-section having a vertical wall and at the top thereof a depending rearwardly directed horizontal flange terminating in a downwardly directed terminal end portion spaced rearwardly from the vertical wall, the bottom of the vertical wall having a forwardly directed horizontal flange with a downwardly directed rib;

a reflector member attached to the rear horizontal support member and spanning the distance between the brackets, said reflector member as viewed in lateral cross-section having an upper vertical portion with a terminal end at the top and a right angle bend at the bottom and a bottom portion, said bottom portion having a rearwardly directed horizontal section supported by the top of the rearwardly directed horizontal flange of the rear support member and having a downwardly directed vertical section with a right angle bend at the bottom and a substantially horizontal flange section extending forwardly from the right angle bend, said flange section having an upwardly directed projection capturing the downwardly directed terminal end of the rear support member between it and the right angle bend and a curved section forward of the projection that frictionally engages the rib of the rear support member; and a cover supported on the frame.

2. In the refrigerator of claim 1 wherein the shelf brackets each have a stop member projecting toward each other and the upper vertical portion of the reflector member at each end thereof engages the stop members.

3. In the refrigerator of claim 1 wherein the reflector member is formed from plastic material.

4. In the refrigerator of claim 1 further including a gasket having a U-shaped body as viewed in lateral cross-section, said gasket being located on top of the forwardly directed horizontal flange of the support member and below the rearwardly directed horizontal section of the reflector member bottom portion and engaging the rear edge of the cover.

5. In the refrigerator of claim 1 wherein the fresh food compartment has slotted vertical tracks on the rear wall of the compartment and the two shelf brackets each have hook elements at the rear end thereof for engaging the slotted tracks to support the frame.

6. In the refrigerator of claim 1 wherein the removable rigid unitary frame is nearly the entire width of the fresh food compartment.

7. In the refrigerator of claim 1 wherein the cover is tempered glass.

8. In the refrigerator of claim 1 wherein the rib is located at the junction of the vertical wall and the forwardly directed horizontal flange.

* * * * *